United States Patent [19]

Oyama

[11] 4,455,458

[45] Jun. 19, 1984

[54] PULSE SWITCH

[75] Inventor: Akira Oyama, Miyagi, Japan

[73] Assignee: Alps Electric Co., Ltd., Tokyo, Japan

[21] Appl. No.: 409,871

[22] Filed: Aug. 20, 1982

[30] Foreign Application Priority Data

Aug. 20, 1981 [JP] Japan ..... 56-123873[U]

[51] Int. Cl.[3] ..... H01H 9/00

[52] U.S. Cl. ..... 200/1 B; 200/74

[58] Field of Search ..... 200/11 R, 11 A, 11 B, 200/11 C, 11 D, 11 DA, 11 E, 11 EA, 11 G, 11 H, 11 J, 11 K, 11 TC, 11 TW, 1 B, 68, 73, 74

[56] References Cited

U.S. PATENT DOCUMENTS

| | | | |
|---|---|---|---|
| 2,707,741 | 5/1955 | Collura | 200/257 |
| 3,736,390 | 5/1973 | Lockard | 200/11 |
| 3,892,931 | 7/1975 | Lockard | 200/11 R |
| 4,246,453 | 1/1981 | Marchese et al. | 200/11 R |
| 4,246,454 | 1/1981 | Ray | 200/38 R |
| 4,282,415 | 8/1981 | Shimizu et al. | 200/77 |
| 4,395,604 | 7/1983 | Tominaga | 200/74 |

*Primary Examiner*—E. A. Goldberg

*Assistant Examiner*—Morris Ginsburg

*Attorney, Agent, or Firm*—Guy W. Shoup; Gerard F. Dunne

[57] ABSTRACT

A pulse switch comprises a main disc and an auxiliary disc; with the main disc being adapted to rotate independently of the shaft of the switch and normally being held in its neutral position, and the auxiliary disc being adapted to rotate along with the shaft. A common contactor and a transfer contactor are fixed to the main disc, with the common contactor normally being held in contact with the common contact, and the transfer contactor being brought into contact with the transfer contact when the main disc has been rotated a predetermined angle. Radiating teeth are formed on the main disc to face the auxiliary disc; and crests are provided on the auxiliary disc to face the main disc and mesh with the teeth thereof. Radiating teeth are formed on the opposite side of the auxiliary disc and have the same shape as that of the teeth of the main disc; and pressing projections are provided to engage the teeth of the auxiliary disc to press the auxiliary disc against the main disc.

3 Claims, 8 Drawing Figures

PULSE SWITCH

Background of the Invention

The present invention relates to a pulse switch which generates a large number of pulse signals by the rotation of a shaft.

Such pulse switches should preferably be small in size and be easy to assemble. It is also required that the pulse signals be stably generated. Further, it is desirable that a feel or click be transmitted to the operating shaft each time a pulse is generated.

Summary of the Invention

An object of the present invention is to provide a pulse switch which meets the requirements mentioned above.

In one aspect of performance of the present invention, a pulse switch comprises a case which includes a pair of opposing wall plates defining an operating space therebetween, and a shaft extends into the operating space and is rotatably supported by the wall plates. A common contact and at least one transfer contact are disposed on an inner surface of one of said wall plates; while a main disc and an auxiliary disc are mounted in the operating space. The main disc is located on a side of the wall plate with the contacts disposed thereon, the auxiliary disc is located on a side of the other case wall plate. The main disc is adapted to rotate independently of the shaft and is normally held in its neutral position by a return spring, while the auxiliary disc is adapted to rotate along with the shaft. A common contractor and a transfer contactor are fixed to the main disc, and the common contractor is normally held in contact with the common contact. The transfer contactor is adapted to be brought into contact with the transfer contact when said main disc has been rotated a predetermined angle. A plurality of radiating teeth are formed on a side of the main disc facing the auxiliary disc; and crests are provided on a side of the auxiliary disc facing the main disc. These crests mesh with the teeth of the main disc. A plurality of radiating teeth are also formed on the opposite side of the auxiliary disc and have the same shape as the teeth of the main disc; and pressing projections are disposed in said case, which mesh with the teeth of the auxiliary disc to press the auxiliary disc against the main disc.

Preferred Embodiment of the Invention

Hereunder, an embodiment of the present invention will be described with reference to the drawings.

Figure 1:
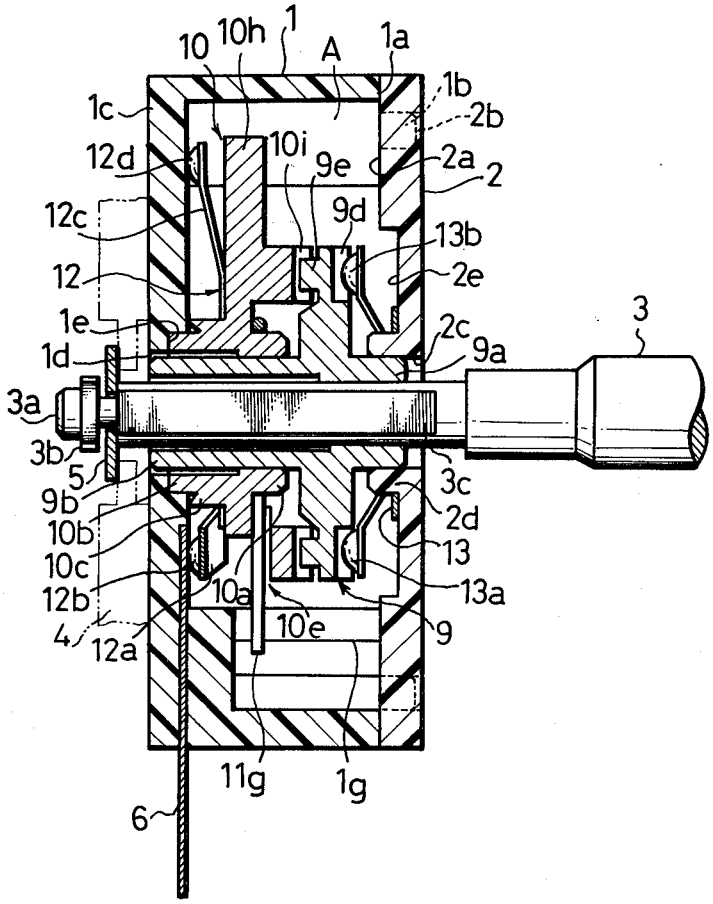
FIG. 1 is a vertical sectional view of a pulse switch according to the present invention.

FIG. 1 is a vertical sectional view which shows a pulse switch according to the present invention.

Figure 2:
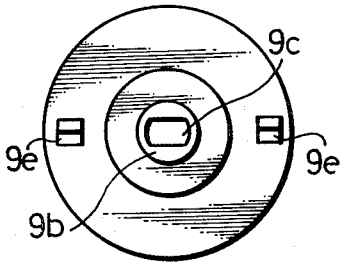
FIG. 2 is a front view of an auxiliary disc for the pulse switch.
Figure 3:
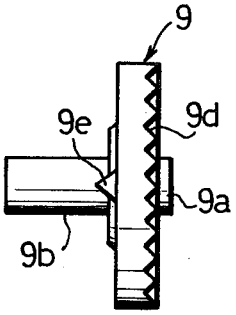
FIG. 3 is a side view of the auxiliary disc.
Figure 4:
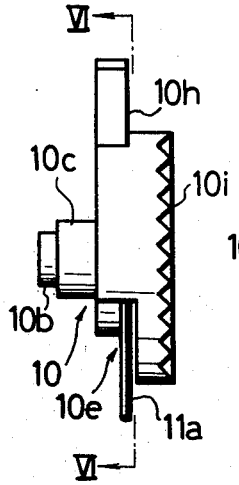
FIG. 4 is a side view of a main disc for the pulse switch.
Figure 5:
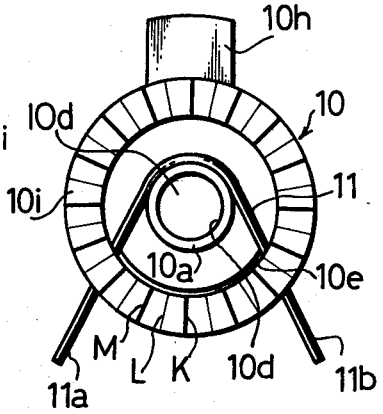
FIG. 5 is a front view of the main disc.
Figure 6:
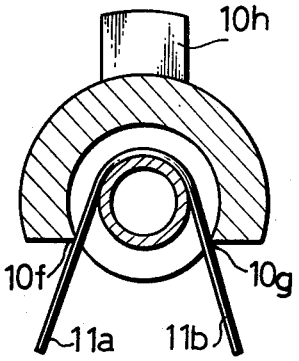
FIG. 6 is a sectional view taken along line VI—VI in FIG. 4.
Figure 7:
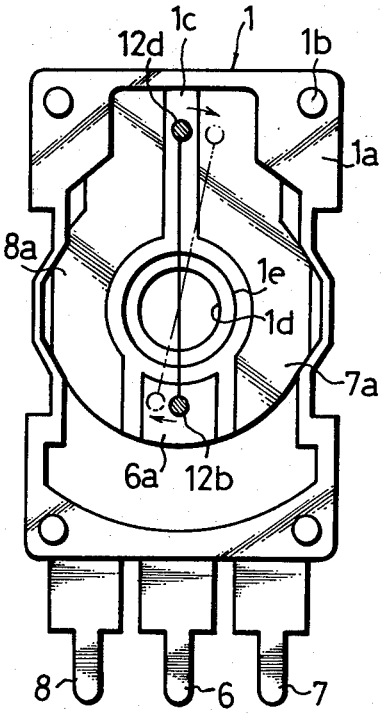
FIG. 7 is a front view of a case for the pulse switch.
Figure 8:
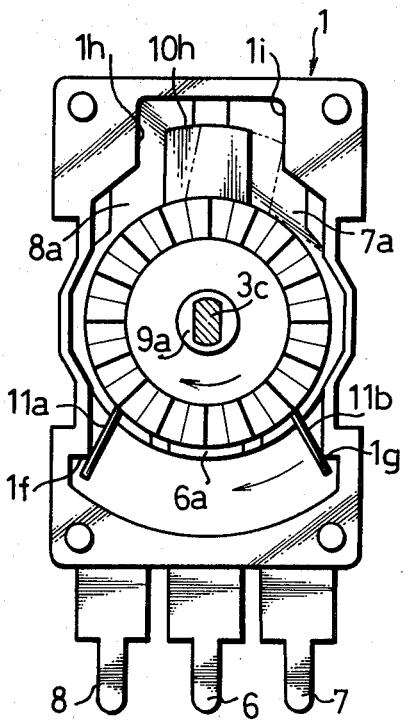
FIG. 8 is a front view showing the state in which the main disc and the auxiliary disc are mounted on the case.

Numeral 1 in the figure designates a case for the main portions of the switch, and numeral 2 a cover. Both the case 1 and cover 2 are molded of an insulating material. Positioning pins 1*b* are provided at the four corners of the surface 1*a* of the case 1 which mates with the cover 2 (refer to FIG. 7), while holes 2*b* are formed at the four corners of the mating surface 2*a* of the cover 2. The case 1 is positioned relative the cover 2 by inserting the positioning pins 1*b* into the holes 2*b*. The case 1 and the cover 2 are fixed to each other by suitable means, and an operating space A is defined thereby. A shaft hole 1*d* is provided in the central part of the bottom wall plate 1*c* of the case 1, and a step 1*e* is formed around the shaft hole 1*d* (refer to FIG. 7). On the other hand, a shaft hole 2*c* is also provided in the central part of the cover 2, and a cylindrical portion 2*d* is formed in a manner to extend inwardly around the shaft hole 2*c*. A shaft 3 is inserted through both the shaft holes 1*d* and 2*c*. The right end of the shaft 3 can communicate with a source for rotational torque such as the intermediate shaft of a transmission mechanism, or the like. The fore end 3*a* of the shaft 3 is inserted into a push-pull switch 4 (in FIG. 1, only a part of the case of this switch is shown) which is disposed in a stage succeeding to the pulse switch of the present invention, and a ring 5 or the like is mounted on the base part of a flange 3*b* so as to prevent the shaft 3 from falling off. By disposing the push-pull switch 4 at the rear end of the pulse switch in this manner, both the rotating and reciprocating operations of the shaft 3 are permitted, so that signals based on both the rotating and reciprocating operations of the shaft can be generated. Three switch terminals 6, 7 and 8 are mounted on the bottom wall plate 1*c* of the case 1 (FIG. 7). These switch terminals 6, 7 and 8 are inserted and affixed during the molding of the case 1. The upper part of the switch terminal 6 forms a common contact 6*a*, and it is situated so as to be exposed on the inner surface of the bottom wall plate 1*c* at a location beneath the shaft hole 1*d*. The upper part of the switch terminal 7 serves as a transfer contact 7*a* and the upper part of the switch terminal 8 as a transfer contact 8*a*, and they are exposed on the inner surface of the bottom wall plate 1*c*. The transfer contacts 7*a* and 8*a* extend around the shaft hole 1*d*, and they are arranged bisymmetrically with respect to the shaft hole 1*d*. An auxiliary disc 9 is mounted within the operating space A near the cover 2. As shown in FIG. 2 and FIG. 3, the auxiliary disc 9 is formed with bosses 9*a* and 9*b* on the right and left sides, and an oval hole 9*c* is provided in the axial part of the boss 9*a*. In mounting the auxiliary disc 9 into the operating space A, a portion 3*c* of the shaft 3 having an oval section is inserted into the oval hole 9*c*. The boss 9*a* is inserted into the shaft hole 2*c* of the case 2, whereby the shaft 3 and the auxiliary disc 9 are supported on the case 2. Owing to the engagement between the cut portion 3*c* and the oval hole 9*c*, the auxiliary disc 9 is adapted to rotate along with the shaft 3, and besides, it can slide in the axial direction of the shaft 3. Further, a plurality of radiating teeth 9*d* are formed on that side of the auxiliary disc 9 which faces the wall of the cover, and a pair of crests 9*e* are formed on the surface of the auxiliary disc 9 on the opposite side. A main disc 10 is mounted in the operating space A so as to be near the bottom wall plate 1c of the case 1. As shown in FIG. 4 and FIG. 5, the main disc 10 is formed on its right side with a boss 10a, and on its left side with a boss 10b and a stopper 10c larger in diameter than the boss 10b. A shaft hole 10d is provided in the axial parts of both the bosses 10a and 10b. Within the operating space A, the boss 9b of the auxiliary disc 9 is inserted through the shaft hole 10d of the main disc 10. The left boss 10b of the main disc 10 is inserted into the step 1e formed in the bottom wall plate 1c of the body case 1, and the fore end of the stopper 10c abuts lightly on the inner surface of the bottom wall plate 1c. Owing to the engagement between the boss 10b and the step 1e, the main disc 10 and the fore end part of the shaft 3 are held in a particular position relative the bottom wall plate 1c. Since the shaft hole 10d of the main disc 10 is a circular hole, this main disc 10 can turn independently of the rotation of the shaft 3 and the auxiliary disc 9. A cut-away portion 10e is formed in the lower part of the main disc 10. The end parts 11a and 11b of a return spring 11 wound on the upper surface of the right boss 10a project outwardly through the cut-away portion 10e, and the end parts 11a and 11b are supported in pressed contact with the respective end edges 10f and 10g of the cut-away portion 10e (refer to FIG. 6). When the main disc 10 has been assembled in the operating space A, the ends 11a and 11b of the return spring 11 abut against respective edges 1f and 1g formed in the respective side walls of the case 1, as illustrated in FIG. 8. The main disc 10 is normally held in its neutral position (the position shown in FIG. 8) by the return spring 11. When the main disc 10 is rotated either rightwards or leftwards, one end 11a or 11b of the return spring 11 comes away from the edge 1f or 1g, and a returning spring force is generated by the other end, so that the main disc 10 is urged back to the neutral position. A stopper 10h is protrusively provided in the upper part of the main disc 10, and when the main disc 10 is rotated a predetermined angle within the operating space A, this stopper 10h abuts against a control face 1h or 1i (FIG. 8) formed in the inner surface of each side wall of the case. A plurality of radiating teeth 10i are formed on that side of the main disc 10 which faces the auxiliary disc 9. The teeth 10i are formed at the same pitches and in the same shape as those of the teeth 9d formed in the auxiliary disc 9, and the crests 9e protrusively provided in the auxiliary disc 9 have a shape adapted to mesh with the teeth 10i. A contact 12 is mounted on that side of the main disc 10 which faces the bottom wall plate 1c. A common contactor 12b is formed at the fore end of a lower arm 12a constructed by bending a part of the contacting fixture 12, and a transfer contactor 12d is formed at the fore end of an upper arm 12c. As illustrated in FIG. 7, the common contactor 12b lies in contact with the common contact 6a, while the transfer contactor 12d comes into contact with the transfer contact 7a, the transfer contact 8a, or the part of the inner surface of the bottom wall plate 1c lying between both the transfer contacts 7a and 8a. A pressing member 13 is caulked and fixed to the outer peripheral part of the cylindrical portion 2d formed in the central part of the cover 2. The upper and lower parts of the pressing member 13 are bent inwardly, and a pair of pressing projections 13a and 13b are provided at the ends of the bent parts of the pressing member 13. The pressing projections 13a and 13b mesh with the respective teeth 9d of the auxiliary disc 9, and act to press the auxiliary disc 9 against the main disc 10 owing to the resiliency of the pressing member 13 itself. Owing to the pressing force, the crests 9e of the auxiliary disc 9 are held in meshing engagement with the teeth 10i of the main disc 10.

Now, the operation of the pulse switch according to the present invention will be described.

In the state in which the pulse switch is not operating, the main disc 10 is held in its neutral position by the return spring 11, that is, it assumes the posture in which the stopper 10h lies in the position intermediate between both the control faces 1h and 1i, as indicated by a solid line in FIG. 8. At this time, the common contactor 12b which is fixed to the main disc 10 and which extends downwardly lies in the central part of the common contact 6a as indicated by a solid line in FIG. 7, while the transfer contactor 12d which extends upwardly lies on that part of the bottom wall plate 1c which is intermediate between the right and left transfer contacts 7a and 8a. Under this state, the switch terminal 6 is not conductive to the other switch terminal 7 or 8. Meanwhile as stated before, the pressing projections 13a and 13b lie in engagement with the valleys between the teeth 9d of the auxiliary disc 9. Also the pair of crests 9e of the auxiliary disc 9 lie in engagement with the valleys between the teeth 10i of the main disc 10, that is, a valley at a part K shown in FIG. 5 and another valley diametrically across from the position K, respectively.

Subsequently, when the shaft 3 is rotated clockwise (in the direction of arrow in FIG. 8), the auxiliary disc 9 is also rotated clockwise along with the shaft 3. At this time, the crests 9e of the auxiliary disc 9 rotate the main disc 10 clockwise while being in engagement with the valley K and the diametrically opposed valley of the teeth 10i of the main disc 10. When the angle of rotation has become a half pitch of the teeth 10i, that is, before the crest 9e has turned from the valley K to a top L, the stopper 10h protruding upwardly of the main disc 10 abuts against one control face 1i of the case 1 (a state indicated by a chain line in FIG. 8). At this time, the contact 12 fixed to the main disc 10 is rotated together with the main disc, and the transfer contactor 12d extending upwardly of the contact 12 comes into contact with the transfer contact 7a as illustrated by a chain line in FIG. 7. On the other hand, the common contactor 12b extending downwards turns in a range so that it is maintained in contact with the common contact 6a. Therefore, the common contact 6a and the transfer contact 7a are rendered conductive through the contacting fixture 12.

When the shaft 3 is further rotated clockwise, the main disc 10 no longer rotates because of the abuttal between the stopper 10h and the control face 1i, and hence, the crests 9e of the auxiliary disc 9 advance from the valley K and the opposed valley onto the top L and the opposed top of the teeth 10i of the main disc 10. At this point of time, the end 11b of the return spring 11 has come away from the edge 1g by turning along with the main disc 10, and the returning resilient force has developed. Therefore, the moment the crests 9e have advanced onto the top L and the opposed top, the main disc 10 is returned to the neutral position by the returning resilient force, and the common contactor 12b and the transfer contactor 12d are brought back to the solid-line positions in FIG. 7. In particular, the transfer contactor 12d comes out of contact with the transfer contact 7a, and the conduction between the switch terminals 6 and 7 is released. That is, in this course, a pulse corresponding to one wave is generated in a circuit which is connected to the switch terminals 6 and 7. On the other hand, at the time, after the crests 9*e* of the auxiliary disc 9 have advanced onto the top L and the opposed top of the teeth 10*i* of the main disc 10, the main disc 10 has returned to the neutral position owing to the force of the return spring 11, the crests 9*e* lie in engagement with a valley M adjoining the top L and a valley diametrically opposed to the valley M. That is, the auxiliary disc 9 has rotated one pitch of the teeth 10*i*. The auxiliary disc 9 is formed with the teeth 9*d* in the same shape and at the same pitches as those of the main disc 10. Therefore, when the auxiliary disc 9 has rotated one pitch, each of the pressing projections 13*a* and 13*b* moves from one valley to the adjoining valley in the teeth 9*d* by striding over the intervening top. That is, the auxiliary disc 9 has rotated an extent corresponding to one click operation. As described above, in this pulse switch, when the teeth 9*d* of the auxiliary disc 9 have rotated the extent of one click relative to the pressing projections 13*a* and 13*b*, the crests 9*e* of the auxiliary disc 9 rotate the extent of one click (from the root K to the valley M) relative to the teeth 10*i* of the main disc 10. Meanwhile, the main disc 10 rotates one reciprocation so as to generate the pulse of one wave. Therefore, while the shaft 3 rotates 360°, pulses are generated in the number of the respective teeth 9*d* and 10*i*, in other words, the number of click operations. In addition, when the shaft 3 is rotated counterclockwise, operations symmetric to the foregoing are performed. The transfer contactor 12*d* is connected with and disconnected from the other transfer contact 8*a*, and the switch terminals 6 and 8 are electrically connected and disconnected. Pulses are generated in a circuit which is connected to the switch terminals 6 and 8. When a pulse potential at this time is made reverse to that in the case of connecting and disconnecting the terminals 6 and 7, pulses of the opposite potentials can be generated according to the forward and reverse rotations of the shaft 3.

In the illustrated embodiment, when the main disc 10 has rotated a predetermined angle, the stopper 10*h* abuts against the control face 1*i* so as to regulate the rotation, and at that time, the crests 9*e* of the auxiliary disc 9 advance from the valleys to the tops of the teeth 10*i* of the main disc 10. Regarding this operation, the following measure may well be taken by way of example. The stopper 10*h* is not disposed. The return spring 11 is so set that when the main disc 10 has rotated a predetermined angle, the returning resilient force of the spring increases. The rotation of the main disc 10 is regulated by this returning force, and the crests 9*e* of the auxiliary disc 9 advance from the valleys onto the tops of the teeth 10*i*.

As set forth above, according to the present invention, both the main disc and the auxiliary disc which are disposed in the case are formed with the teeth, and the crests of the auxiliary disc are held in mesh with the teeth of the main disc, while the pressing projections are held in mesh with the teeth of the auxiliary disc. Therefore, the main disc oscillates the number of times equal to the number of click operations between the teeth of the auxiliary disc and the pressing projections, and pulses in a number corresponding to the number of the click operations can be stably generated. It is therefore possible to vary the number of pulses to be generated in one revolution of the shaft, by arbitrarily setting the number of the click operations or the number of the aforementioned teeth. Moreover, the common contact and the transfer contacts are disposed on the inner wall surface of the case, and a space for arranging the two discs may be secured within the operating space A in the case. This brings forth the effect that the whole switch can be made small in size and light in weight.

I claim:

1. A pulse switch comprising:

a case including a pair of opposing wall portions defining an operating space therebetween, a shaft extending into the operating space and rotatably supported by the wall portions, a common contact and at least one transfer contact disposed on an inner surface of one of said wall portions, a main disc and an auxiliary disc mounted in said operating space, said main disc being located near the wall portion having the contacts disposed thereon, said auxiliary disc being located near the other wall portion, said main disc being adapted to rotate independently of said shaft and being normally held in its neutral position by a return spring, said auxiliary disc being adapted to rotate along with said shaft, a common contactor and a transfer contactor fixed to said main disc, said common contactor being normally held in contact with said common contact, said transfer contactor being adapted to be brought into contact with said transfer contact when said main disc has rotated a predetermined angle, a plurality of radiating teeth formed on a side of said main disc facing said auxiliary disc, crests provided on a side of said auxiliary disc facing said main disc, said crests being adapted to mesh with said teeth, a plurality of radiating teeth formed on the opposite side of said auxiliary disc and having the same shape as said teeth of said main disc, and pressing projections disposed in said case and adapted to mesh with said teeth of said auxiliary disc to press said auxiliary disc against the main disc.

2. A pulse switch according to claim 1, wherein the common contact, and two transfer contacts are disposed on the wall portion with one of said transfer contacts being connected with said common contact when said shaft is rotated in one direction, and the other of said transfer contacts being connected with said common contact when said shaft is rotated in the other direction.

3. A pulse switch according to claim 1, wherein the wall portions are separately prepared and are assembled to form said case, and said pressing projections are fixed onto an inner surface of the wall portion not bearing said contacts.

* * * * *